US007182693B2

(12) United States Patent
Andoh et al.

(10) Patent No.: US 7,182,693 B2
(45) Date of Patent: Feb. 27, 2007

(54) TARGET DEVICE AND LIGHT DETECTING DEVICE

(75) Inventors: Tadashi Andoh, Tokyo (JP); Hiroshi Watanabe, Tokyo (JP)

(73) Assignee: NEC Corporation, Tokyo (JP)

( * ) Notice: Subject to any disclaimer, the term of this patent is extended or adjusted under 35 U.S.C. 154(b) by 726 days.

(21) Appl. No.: 10/392,986

(22) Filed: Mar. 21, 2003

(65) Prior Publication Data

US 2003/0211892 A1 Nov. 13, 2003

(30) Foreign Application Priority Data

May 10, 2002 (JP) ..... 2002-135305

(51) Int. Cl.
*A63B 67/00* (2006.01)
*A63F 9/02* (2006.01)

(52) U.S. Cl. ..... 463/49

(58) Field of Classification Search ..... None
See application file for complete search history.

(56) References Cited

U.S. PATENT DOCUMENTS

| | | | |
|---|---|---|---|
| 4,164,081 | A | 8/1979 | Berke |
| 4,487,583 | A | 12/1984 | Brucker et al. |
| 5,317,582 | A | 5/1994 | Siebert |
| 5,788,500 | A | 8/1998 | Gerber |
| 6,322,365 | B1 | 11/2001 | Shechter et al. |

FOREIGN PATENT DOCUMENTS

| | | | |
|---|---|---|---|
| DE | CH 623 652 | A5 | 5/1981 |
| EP | 1 281 926 | A2 | 2/2003 |

(Continued)

OTHER PUBLICATIONS

European Search Report dated Aug. 13, 2003.

(Continued)

*Primary Examiner*—Mark Sager
(74) *Attorney, Agent, or Firm*—McGinn IP Law Group, PLLC

(57) ABSTRACT

When a light beam shot from a light gun hits a target plate mounted on a target device, the light beam is detected by a beam detected position detecting unit, which generates a current based on the shot impact position of the light beam on the target plate. An extraneous light detecting unit generates a current based on extraneous light applied to the target device. The current generated by the beam detected position detecting unit or a voltage based on the current, and the current generated by the extraneous light detecting unit or a voltage based on the current are supplied to a subtractor, which subtracts the current generated by the extraneous light detecting unit or the voltage based on the current from the current generated by the beam detected position detecting unit or the voltage based on the current, and outputs a differential current or voltage value. Thus, an extraneous light component is removed from the current generated by the beam detected position detecting unit. Thereafter, a position calculating unit recognizes the light beam shot from the light gun and detects the shot impact position of the light beam on the target plate based on the differential current or voltage value.

10 Claims, 4 Drawing Sheets

FOREIGN PATENT DOCUMENTS

| | | |
|---|---|---|
| EP | 1 336 813 A2 | 8/2003 |
| JP | 59-056778 | 4/1984 |
| JP | 61-233303 | 10/1986 |
| JP | 2-259398 | 10/1990 |
| JP | 2001-157227 | 6/2001 |
| KR | 20-0206981 | 12/2000 |

OTHER PUBLICATIONS

Singaporean Office Action, dated Jun. 25, 2004.
Korean Office Action dated Sep. 29, 2005, wih partial English translation.
Japanese Office Action dated Mar. 29, 2006 and partial English translation.

Fig. 1 *(Prior Art)*
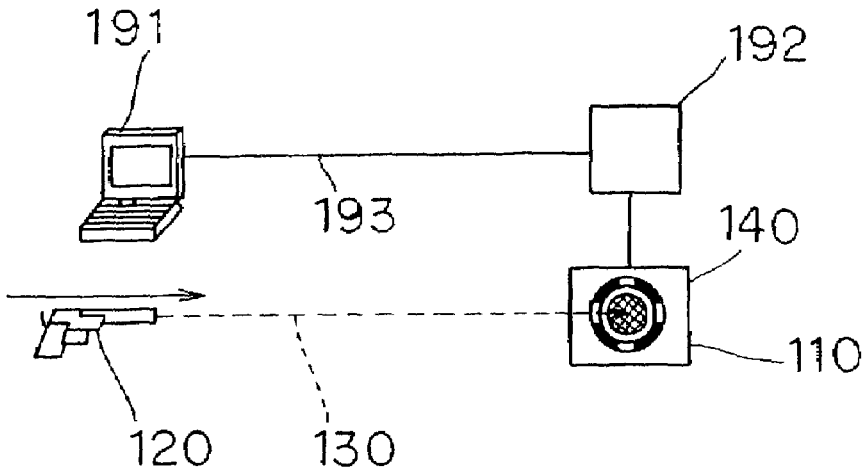
Fig. 2 *(Prior Art)*
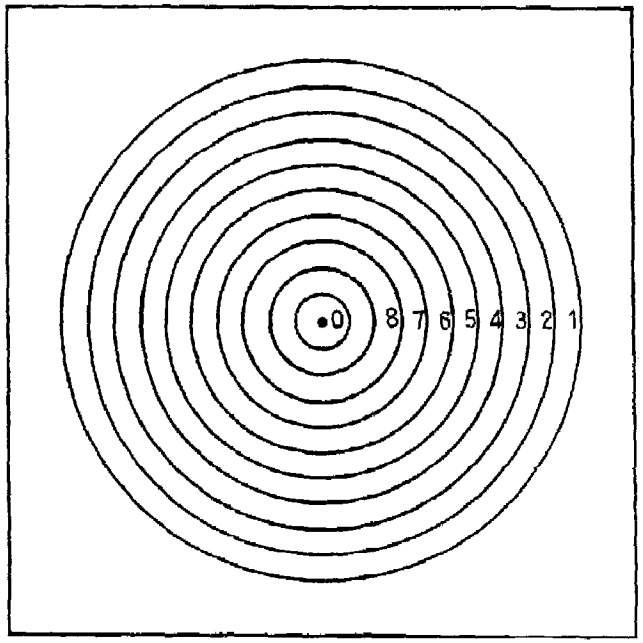

Fig. 3 *(Prior Art)*
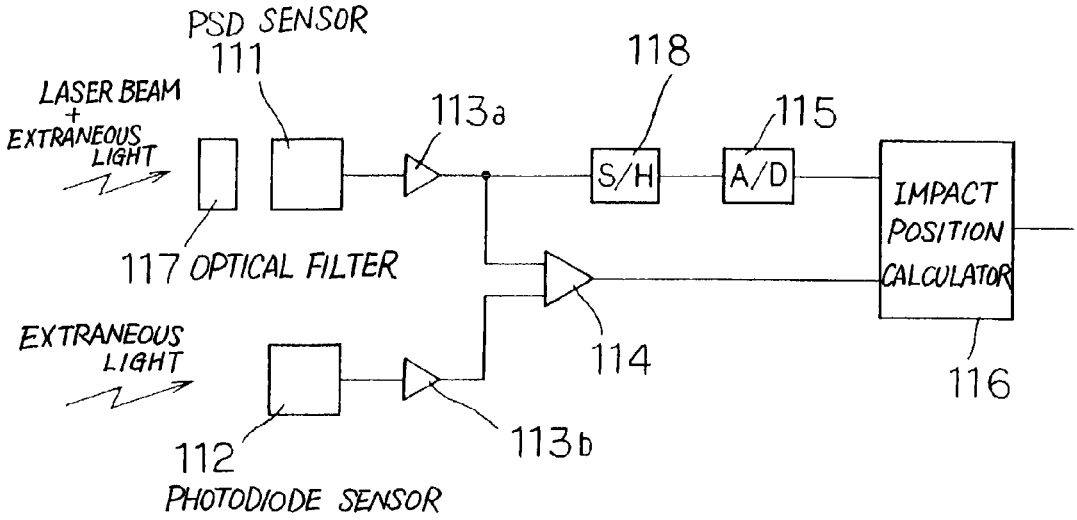
Fig. 4a *(Prior Art)*
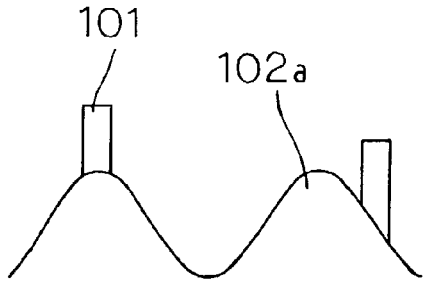
Fig. 4b *(Prior Art)*
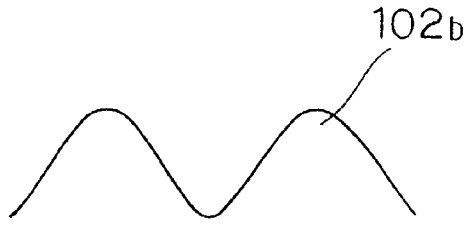
Fig. 4c *(Prior Art)*
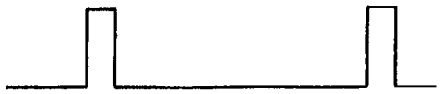

TARGET DEVICE AND LIGHT DETECTING DEVICE

BACKGROUND OF THE INVENTION

1. Field of the Invention

The present invention relates to a target device and a light detecting device for receiving a light beam such as a laser beam or the like which is applied thereto and detecting the position where the light beam is applied.

2. Description of the Related Art

Target shooting sports including gun shooting, Japanese archery, archery, etc. have heretofore gained popularity among many people. At present, not only Japanese archery and archery, but also gun shooting are played in competitions. According to a typical gun shooting competition, a player shoots a bullet from an air rifle or a laser beam from a laser gun toward a target, and competes for a higher score based on the accuracy with which the bullet or the laser beam hits the target.

FIG. 1 of the accompanying drawings shows partly in block form a conventional gun shooting competition system for shooting a target with a laser beam emitted from a laser gun. As shown in FIG. 1, the conventional gun shooting competition system has laser gun 120 operated by a shooter for shooting laser beam 130, target device 110 for detecting a shot impact position where laser beam 130 shot from laser gun 120 hits target plate 140 mounted on target device 110, display unit 191 for displaying the information as to the shot impact on target device 110, and switching unit 192 interconnecting target device 110 and display unit 191. Laser gun 120 and target device 110 are spaced from each other by a predetermined distance for shooting competitions. Switching unit 192 comprises a switching hub of 10BASE-T LAN (Local Area Network) 193.

A processing sequence of the conventional gun shooting competition system at the time the shooter shoots laser beam 130 from laser gun 120 will be described below.

When the shooter operates laser gun 120 to shoot laser beam 130 by triggering laser gun 120 while directing laser gun 120 toward target device 110, laser beam 130 is shot from laser gun 120. Laser beam 130 shot from laser gun 120 is typically emitted from a semiconductor laser oscillation device mounted in laser gun 120.

As with a real bullet shot from a real gun, laser beam 130 is shot from the muzzle of laser gun 120 and travels straight in the direction in which laser gun 120 is oriented.

When laser beam 130 shot from laser gun 120 hits target plate 140 mounted on target device 110, target device 110 detects the shot impact position on target plate 140, and transmits information representing the detected shot impact position via switching unit 192 to display unit 191.

Display unit 191 calculates a score of the shot based on the shot impact position information transmitted from target device 110, and displays the calculated score. Display unit 191 has registered therein information for identifying the shooter, e.g., the identification number of the shooter, and information representing the present shot number of the laser beam shot by the shooter. Therefore, display unit 191 also displays the identification number of the shooter, the present laser beam number, the score corresponding to the laser beam number, the total score gained thus far, and the shot impact position of laser beam 130 on target plate 140, either simultaneously or at spaced time intervals.

As shown in FIG. 2 of the accompanying drawings, target plate 140 has on its surface ten annular areas, including a central circular area just around center O, divided by ten concentric circles around center O. These areas are also referred to as score areas. Target plate 140 also has an outside area around the annular areas. The shooter gets no score when laser beam 130 hits the outside area. A score for the outermost annular area, i.e., the annular area marked with "1", is 1. Scores for the other annular areas are progressively incremented by 1 toward center O, and the score for the central circular area is 10. A score which the shooter obtains when shooting target plate 140 is determined based on the distance from center O of target plate 140 to the impact position on target plate 140.

As shown in FIG. 3 of the accompanying drawings, target device 110 has optical filter 117 comprising a bandpass filter for receiving laser beam 130 which has been shot from laser gun 120 and hit target plate 140 and passing only a light beam which has the wavelength of laser beam 130 shot from laser gun 120, PSD (Position Sensitive Detector) sensor 111 for detecting the laser beam emitted from laser gun 120 and transmitted through optical filter 117 and generating a current based on the amount of the detected light beam and the shot impact position of laser beam 130 on target plate 140 mounted on target device 110, amplifier 113*a* for amplifying a signal represented by the current generated by PSD sensor 111 and outputting the amplified signal, sample-and-hold circuit 118 for sampling the signal from amplifier 113*a* at given time intervals and outputting the sampled signal, A/D converter 115 for converting the signal output from sample-and-hold circuit 118 into a digital signal and outputting the digital signal, photodiode sensor 112 for generating a current based on an amount of extraneous light applied to target device 110, an amplifier 113*b* for amplifying a signal represented by the current generated by photodiode sensor 112 and outputting the amplified signal, a subtractor 114 for subtracting the signal output from amplifier 113*b* from the signal output from amplifier 113*a* and outputting a differential signal, and impact position calculator 116 for calculating the shot impact position of laser beam 130 on target plate 140 and detecting a shot impact position detecting signal for identifying laser beam 130, which is contained in laser beam 130 shot from laser gun 120, based on the signal output from subtractor 114.

Operation of target device 110 thus constructed will be described below.

When laser beam 130 shot from laser gun 120 hits target plate 140 mounted on target device 110, laser beam 130 is applied to optical filter 117 in target device 110 and only a light beam having the wavelength of laser beam 130 shot from laser gun 120 is transmitted through optical filter 117 and detected by PSD sensor 111.

PSD sensor 111 generates currents based on the amount of the light beam received through optical filter 117 and the impact position of laser beam 130 on target plate 140. PSD sensor 111 has a two-dimensional current generating membrane for generating a current based on the detected light beam. If the light beam received through optical filter 117 is applied as a beam spot to the two-dimensional current generating membrane at a coordinate position (x, y), then the two-dimensional current generating membrane generates therein currents which are two-dimensionally linearly commensurate with the coordinate position (x, y). Specifically, the two-dimensional current generating membrane generates two currents Ix1, Ix2 flowing in two opposite directions along the x-axis and two currents Iy1, Iy2 flowing in two opposite directions along the y-axis.

PSD sensor 111 outputs a signal based on the currents Ix1, Ix2 flowing along the x-axis and a signal based on the currents Iy1, Iy2 flowing along the y-axis. Actually, since PSD sensor 111 also detects extraneous light which has the wavelength laser beam 130 and which has passed through optical filter 117, the signals output from PSD sensor 111 contain currents generated by the extraneous light applied to target device 110 and transmitted through optical filter 117, added to the currents along the x-axis and the currents along the y-axis. PSD sensor 111 outputs the sum of the currents along the x-axis and the currents along the y-axis as a signal representing the amount Σ of light received through optical filter 117.

The signal output from PSD sensor 111 is amplified by amplifier 113*a*, which outputs the amplified signal.

As shown in FIG. 4*a* of the accompanying drawings, the amplified signal output from amplifier 113*a* has a waveform including waveform component 101 based on laser beam 130 shot from laser gun 120 and waveform component 102*a* based on the extraneous light which is applied to target device 110 and transmitted through optical filter 117 and detected by PSD sensor 111.

Photodiode sensor 112 generates a current based on only the extraneous light which is applied to target device 110. A signal represented by the generated current is amplified by amplifier 113*b*, which outputs the amplified signal.

As shown in FIG. 4*b* of the accompanying drawings, the amplified signal output from amplifier 113*b* has a waveform including only waveform component 102*b* based on the extraneous light which is applied to target device 110.

The signal output from amplifier 113*a* is supplied to sample-and-hold circuit 118. Sample-and-hold circuit 118 samples the signal based on laser beam 130 shot from laser gun 120, of the signal output from amplifier 113*a*, at such a time that laser beam 130 is applied to target device 110. Thus, sample-and-hold circuit 118 detects a change in laser beam 130, and outputs a signal representing the detected change in laser beam 130. In this manner, the signal component representing the extraneous light that has the wavelength of laser beam 130 and has passed through optical filter 117 is removed from the signal output from amplifier 113*a*, and hence only the signal based on laser beam 130 shot from laser gun 120 is extracted.

The signal output from sample-and-hold circuit 118 is converted by A/D converter 115 into a digital signal that is applied to impact position calculator 116.

Subtractor 114 subtracts the signal output from amplifier 113*b* as shown in FIG. 4*b* from the signal output from amplifier 113*a* as shown in FIG. 4*a*, thus extracting the signal based on only laser beam 130 shot from laser gun 120 as shown in FIG. 4*c* of the accompanying drawings. The signal extracted by subtractor 114 as shown in FIG. 4*c* is supplied to impact position calculator 116.

Impact position calculator 116 detects a shot impact position detecting signal contained in laser beam 130 shot from laser gun 120 based on the signal output from subtractor 114, and calculates a shot impact position of laser beam 130 on target plate 140 based on the digital signal output from A/D converter 115.

Specifically, when the signal output from subtractor 114 is supplied to impact position calculator 116, impact position calculator 116 converts the current value of the signal representing the amount Σ of light, of the signal output from subtractor 114, into a voltage value, and detects a shot impact position detecting signal for identifying laser beam 130, which is contained in laser beam 130 shot from laser gun 120, depending on the voltage value.

When laser gun 120 shoots laser beam 130, it also outputs a shot impact position detecting signal having a predetermined period and amount of light in order to identify laser beam 130 as being shot from laser gun 120. When impact position calculator 116 detects the shot impact position detecting signal contained in laser beam 130 shot from laser gun 120, using the voltage value of the signal representing the amount Σ of light, of the signal output from subtractor 114, the laser beam detected by target device 110 is identified as being shot from laser gun 120.

When the signal output from A/D converter 115 is supplied to impact position calculator 116, impact position calculator 116 calculates a shot impact position of laser beam 130 on target plate 140, using the current values Ix1, Ix2, Iy1, Iy2 which are generated depending on the shot impact position of laser beam 130, according to the following equations:

$$x=k(Ix2-Ix1)/(Ix2+Ix1) \quad (1)$$

$$y=k(Iy2-Iy1)/(Iy2+Iy1) \quad (2)$$

The beam spot position where both (Ix2−Ix1), (Iy2−Iy1) are zero is defined as the electrical and mechanical coordinate origin (0, 0) of PSD sensor 111. Target plate 140 needs to be positioned two-dimensionally with respect to PSD sensor 111 within an allowable accuracy range.

Inasmuch as the impact position (x, y) calculated according to the above equations is affected by the amount Σ of light due to the characteristics of PSD sensor 111, impact position calculator 116 thereafter divides the value of the impact position (x, y) by the signal representing the amount Σ of light, thus correcting the shot impact position of laser beam 130 on target plate 140.

With target device 110 shown in FIGS. 1 and 3, as described above, the extraneous light having wavelengths different from the wavelength of laser beam 130 shot from laser gun 120 is removed by optical filter 117, and a change in laser beam 130 shot from laser gun 120 is detected. Thus, the signal based on only laser beam 130 shot from laser gun 120 is detected, and the shot impact position of laser beam 130 on target plate 140 is detected based on the signal thus detected. The extraneous light having the wavelength of laser beam 130 shot from laser gun 120 is removed by subtracting the extraneous light detected by photodiode sensor from the light transmitted through optical filter 117, thus detecting the shot impact position detecting signal contained in laser beam 130 shot from laser gun 120. In this fashion, the shot impact position of laser beam 130 on target plate 140 is detected without noise and error.

In order to detect the shot impact position of the laser beam shot from the laser gun on the target plate without noise and error, the extraneous light having wavelengths different from the wavelength of the laser beam shot from the laser gun is removed by the optical filter, and thereafter a change in the laser beam shot from the laser gun is detected. Thus, the signal based on only the laser beam shot from the laser gun is detected, and the shot impact position of the laser beam on the target plate is detected based on the signal thus detected. The extraneous light having the wavelength of the laser beam shot from the laser gun is removed by subtracting the extraneous light detected by photodiode sensor from the light transmitted through optical filter, thus detecting the shot impact position detecting signal contained in the laser beam shot from the laser gun. However, since the optical filter used to remove the extraneous light having wavelengths different from the wavelength of the laser beam shot from the laser gun is expensive, the manufacturing cost of the conventional gun shooting competition system is increased simply by using the optical filter, and hence it is difficult to reduce the manufacturing cost of the conventional gun shooting competition system.

SUMMARY OF THE INVENTION

It is an object of the present invention to provide a target device which is capable of detecting a shot impact position of a laser beam on a target plate without noise and error, without the need for an optical filter.

According to the present invention, when a light beam shot from a light gun hits a target plate mounted on a target device, the light beam is detected by a beam detected position detecting means, which generates a current based on the shot impact position of the light beam on the target plate. An extraneous light detecting means generates a current based on extraneous light applied to the target device. The current generated by the beam detected position detecting means or a voltage based on the current, and the current generated by the extraneous light detecting means or a voltage based on the current are supplied to a subtracting means, which subtracts the current generated by the extraneous light detecting means or the voltage based on the current from the current generated by the beam detected position detecting means or the voltage based on the current, and outputs a differential current or voltage value. Thus, an extraneous light component is removed from the current generated by the beam detected position detecting means. Thereafter, a position calculating means recognizes the light beam shot from the light gun and detects the shot impact position of the light beam on the target plate based on the differential current or voltage value.

As described above, the current generated by the extraneous light detecting means or the voltage based on the current is subtracted from the current generated by the beam detected position detecting means or the voltage based on the current, and the light beam shot from the light gun is recognized and the shot impact position of the light beam on the target plate is calculated based on the differential current or voltage value. Therefore, the light beam detected by the beam detected position detecting means is not limited to a certain light beam having a given wavelength by an optical filter, but the shot impact position of the light beam on the target plate is detected without noise and error.

According to the present invention, as described above, the target device for detecting the shot impact position of the light beam shot from the light gun on the target plate is arranged to subtract the extraneous light component from the light beam which has hit the target plate for thereby removing the extraneous light component, and to recognize the light beam shot from the light gun and detect the shot impact position of the light beam on the target plate based on the extracted light component from which the extraneous light component has been removed. Therefore, the shot impact position of the light beam on the target plate can be detected without noise and error, without the need for an optical filter for extracting only a light component having a certain wavelength from the light that is applied to the target plate.

The principles of the present invention are also applicable to a light detecting device for receiving a light beam having a predetermined pulse signal and detecting a beam spot position where the light beam hits the light detecting device, the light detecting device being arranged to subtract an extraneous light component from the light beam which has hit the light detecting device for thereby removing the extraneous light component, and to detect the pulse signal and detect a beam spot position of the light beam having the pulse signal on the light detecting device. Therefore, the light beam position of the light beam can be detected without noise and error, without the need for an optical filter for extracting only a light component having a certain wavelength from the light that is applied to the light detecting device.

The above and other objects, features, and advantages of the present invention will become apparent from the following description with reference to the accompanying drawings which illustrate an example of the present invention.

BRIEF DESCRIPTION OF THE DRAWINGS

FIG. 1 is a view, partly in block form, a conventional gun shooting competition system which employs a laser gun for shooting a laser beam;

FIG. 2 is a front elevational view of a target plate used in the conventional gun shooting competition system shown in FIG. 1;

FIG. 3 is a block diagram of a circuit arrangement of a target device used in the conventional gun shooting competition system shown in FIG. 1;

FIG. 4*a* is a diagram showing the waveform of a signal output from an amplifier in the target device shown in FIGS. 1 and 3;

FIG. 4*b* is a diagram showing the waveform of a signal output from another amplifier in the target device shown in FIGS. 1 and 3;

FIG. 4*c* is a diagram showing the waveform of a signal output from a subtractor in the target device shown in FIGS. 1 and 3;

DETAILED DESCRIPTION OF THE PREFERRED EMBODIMENT

Figure 5:
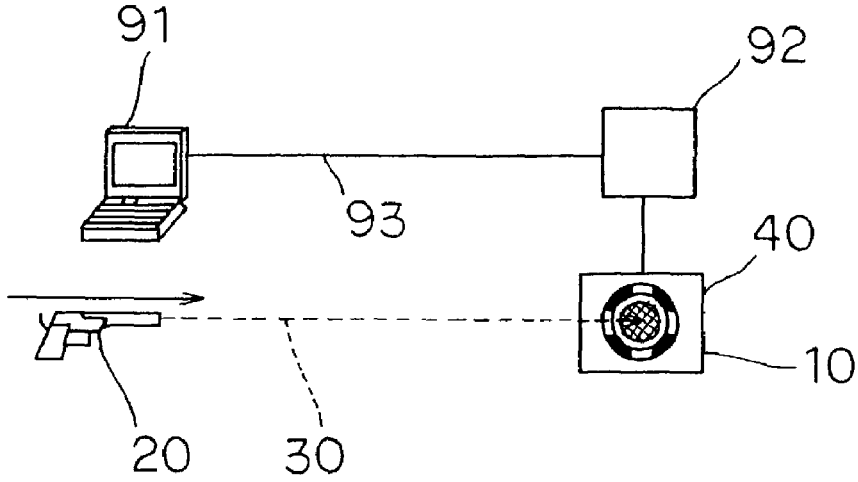
FIG. 5 is a view, partly in block form, a gun shooting competition system which employs a target device according to the present invention.

As shown in FIG. 5, a gun shooting competition system which employs a target device according to the present invention comprises laser gun 20 operated by a shooter for shooting laser beam 30, target device 10 for detecting a shot impact position where laser beam 30 shot from laser gun 20 hits target plate 40 mounted on target device 10, display unit 91 for displaying the information as to the shot impact on target device 10, and switching unit 92 interconnecting target device 10 and display unit 91. Laser gun 20 and target device 10 are spaced from each other by a predetermined distance for shooting competitions. Switching unit 92 comprises a switching hub of 10BASE-T LAN 93.

A processing sequence of the gun shooting competition system at the time the shooter shoots laser beam 30 from laser gun 20 will be described below.

When the shooter operates laser gun 20 to shoot laser beam 30 by triggering laser gun 20 while directing laser gun 20 toward target device 10, laser beam 30 is shot from laser gun 20. Laser beam 30 shot from laser gun 20 is typically emitted from a semiconductor laser oscillation device mounted in laser gun 20.

As with a real bullet shot from a real gun, laser beam 30 is shot from the muzzle of laser gun 20 and travels straight in the direction in which laser gun 20 is oriented.

When laser beam 30 shot from laser gun 20 hits target plate 40 mounted on target device 10, target device 10 detects the shot impact position on target plate 40, and transmits information representing the detected shot impact position via switching unit 92 to display unit 91.

Display unit 91 calculates a score of the shot based on the shot impact position information transmitted from target device 10, and displays the calculated score. Display unit 91 has registered therein information for identifying the shooter, e.g., the identification number of the shooter, and information representing the present shot number of the laser beam shot by the shooter. Therefore, display unit 91 also displays the identification number of the shooter, the present laser beam number, the score corresponding to the laser beam number, the total score gained thus far, and the shot impact position of laser beam 30 on target plate 40, either simultaneously or at spaced time intervals.

Figure 6:
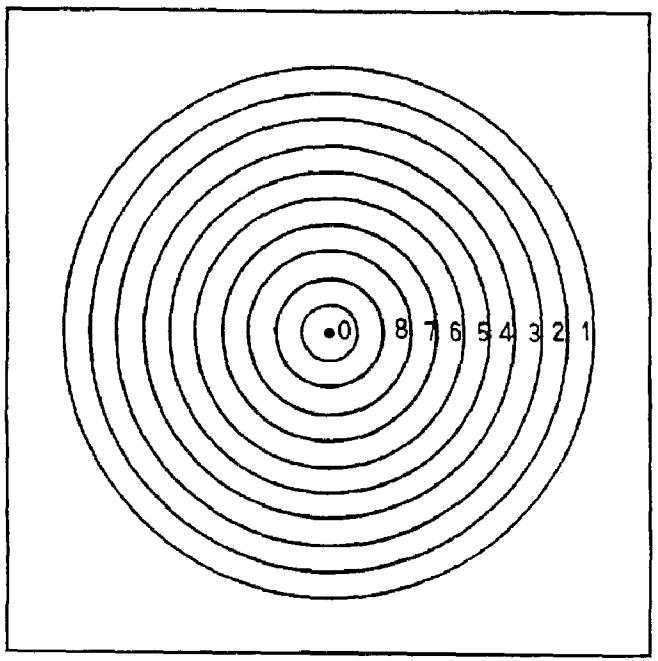
FIG. 6 is a front elevational view of a target plate used on the target device shown in FIG. 5.

As shown in FIG. 6, target plate 40 shown in FIG. 5 has on its surface ten annular areas, including a central circular area just around center O, divided by ten concentric circles around center O. These areas are also referred to as score areas. Target plate 40 also has an outside area around the annular areas. The shooter gets no score when laser beam 30 hits the outside area. A score for the outermost annular area, i.e., the annular area marked with "1", is 1. Scores for the other annular areas are progressively incremented by 1 toward center O, and the score for the central circular area is 10. A score which the shooter obtains when shooting target plate 40 is determined based on the distance from center O of target plate 40 to the impact position on target plate 40.

Figure 7:
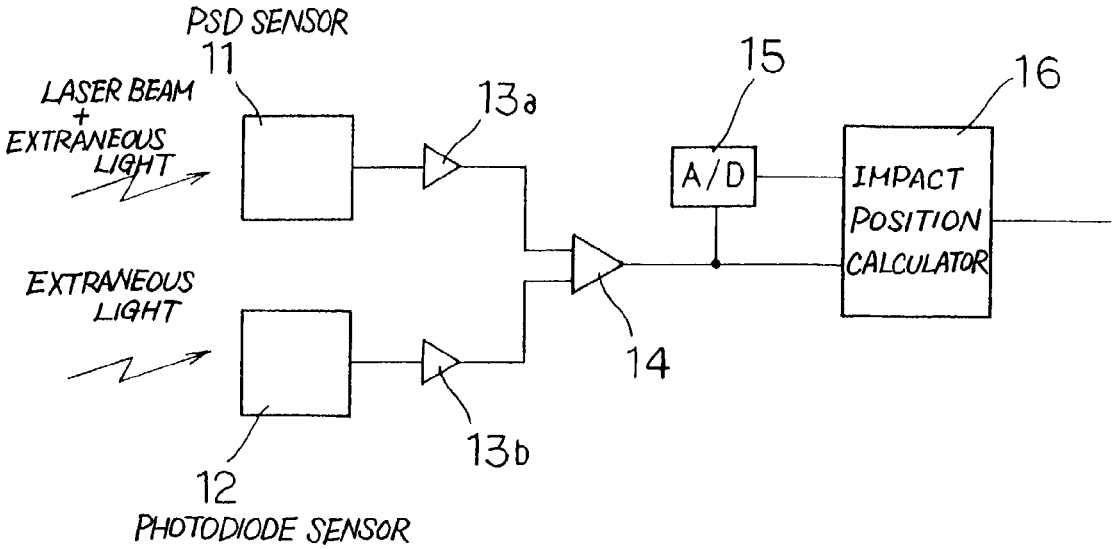
FIG. 7 is a block diagram of a circuit arrangement of the target device shown in FIG. 5.

As shown in FIG. 7, target device 10 has PSD (Position Sensitive Detector) sensor 11 serving as a beam detected position detecting means for detecting laser beam 30 emitted from laser gun 20 and generating a current based on the amount of the detected light beam and the shot impact position of laser beam 30 on target plate 40 mounted on target device 10, amplifier 13*a* for amplifying a signal represented by the current generated by PSD sensor 11 and outputting the amplified signal, photodiode sensor 12 serving as extraneous light detecting means for generating a current based on an amount of extraneous light applied to target device 10, an amplifier 13*b* for amplifying a signal represented by the current generated by photodiode sensor 12 and outputting the amplified signal, a subtractor 14 for subtracting the signal output from amplifier 13*b* from the signal output from amplifier 13*a* and outputting a differential signal, A/D converter 15 for converting the signal output from subtractor 14 into a digital signal and outputting the digital signal, and impact position calculator 16 serving as a position calculating means for calculating the shot impact position of laser beam 30 on target plate 40 and detecting a shot impact position detecting signal for identifying laser beam 30, which is contained in laser beam 30 shot from laser gun 20, based on the signal output from subtractor 14.

Operation of target device 10 thus constructed will be described below.

When laser beam 30 shot from laser beam 20 hits target plate 40 mounted on target device 10, laser beam 30 is detected by PSD sensor 11 in target device 10.

PSD sensor 11 generates currents based on the amount of the light beam detected thereby and the shot impact position of laser beam 30 on target plate 40. PSD sensor 11 has a two-dimensional current generating membrane for generating a current based on the detected light beam. If the detected light beam is applied as a beam spot to the two-dimensional current generating membrane at a coordinate position (x, y), then the two-dimensional current generating membrane generates therein currents which are two-dimensionally linearly commensurate with the coordinate position (x, y). Specifically, the two-dimensional current generating membrane generates two currents Ix1, Ix2 flowing in two opposite directions along the x-axis and two currents Iy1, Iy2 flowing in two opposite directions along the y-axis.

PSD sensor 11 outputs a signal based on the currents Ix1, Ix2 flowing along the x-axis and a signal based on the currents Iy1, Iy2 flowing along the y-axis. Actually, since PSD sensor 11 also detects extraneous light detected by target device 10, the signals output from PSD sensor 11 contain currents generated by the extraneous light applied to target device 10, added to the currents along the x-axis and the currents along the y-axis. PSD sensor 11 outputs the sum of the currents along the x-axis and the currents along the y-axis as a signal representing the amount Z of light detected by target device 11.

The signal output from PSD sensor 11 is amplified by amplifier 13*a*, which outputs the amplified signal.

Figure 8A:
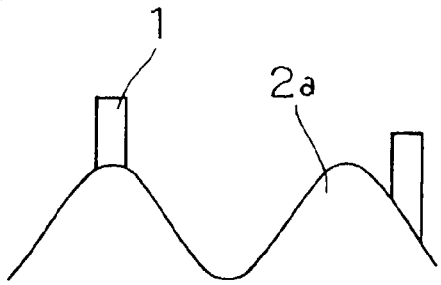
FIG. 8*a* is a diagram showing the waveform of a signal output from an amplifier in the target device shown in FIGS. 5 and 7.

As shown in FIG. 8*a*, the amplified signal output from amplifier 13*a* has a waveform including waveform component 1 based on laser beam 30 shot from laser gun 20 and waveform component 2*a* based on the extraneous light which is detected by target device 10.

Photodiode sensor 12 generates a current based on only the extraneous light which is detected by target device 10. A signal represented by the generated current is amplified by amplifier 13*b*, which outputs the amplified signal.

Figure 8B:
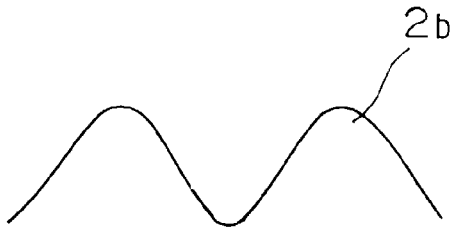
FIG. 8*b* is a diagram showing the waveform of a signal output from another amplifier in the target device shown in FIGS. 5 and 7.

As shown in FIG. 8*b*, the amplified signal output from amplifier 13*b* has a waveform including only waveform component 2*b* based on the extraneous light which is detected by target device 10.

Figure 8C:
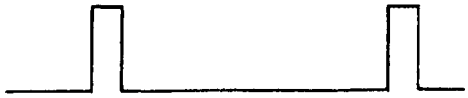
FIG. 8*c* is a diagram showing the waveform of a signal output from a subtractor in the target device shown in FIGS. 5 and 7.

The signals output from amplifiers 13*a*, 13*b* are supplied to subtractor 14. Subtractor 14 subtracts the signal output from amplifier 13*b* as shown in FIG. 8*b* from the signal output from amplifier 13*a* as shown in FIG. 8*a*, thus extracting the signal based on only laser beam 30 shot from laser gun 20 as shown in FIG. 8*c*. The signal extracted by subtractor 14 as shown in FIG. 8*c* is supplied to A/D converter 15 and impact position calculator 16.

A/D converter 15 converts the signal output from subtractor 14 into a digital signal, which is supplied to impact position calculator 16.

Impact position calculator 16 detects a shot impact position detecting signal contained in laser beam 30 shot from laser gun 20 based on the signal output from subtractor 14, and calculates a shot impact position of laser beam 30 on target plate 40 based on the digital signal output from A/D converter 15.

Specifically, when the signal output from subtractor 14 is supplied to impact position calculator 16, impact position calculator 16 converts the current value of the signal representing the amount Σ of light, of the signal output from subtractor 14, into a voltage value, and detects a shot impact position detecting signal for identifying laser beam 30, which is contained in laser beam 30 shot from laser gun 20, depending on the voltage value.

When laser gun 20 shoots laser beam 30, it also outputs a shot impact position detecting signal having a predetermined period and amount of light in order to identify laser beam 30 as being shot from laser gun 20. When impact position calculator 16 detects the shot impact position detecting signal contained in laser beam 30 shot from laser gun 20, using the voltage value of the signal representing the amount Σ of light, of the signal output from subtractor 14, the laser beam detected by target device 10 is identified as being shot from laser gun 20.

When the signal output from A/D converter 15 is supplied to impact position calculator 16, impact position calculator 16 calculates a shot impact position of laser beam 30 on target plate 40, using the current values Ix1, Ix2, Iy1, Iy2 which are generated depending on the shot impact position of laser beam 30, according to the following equations:

$$x=k(Ix2-Ix1)/(Ix2+Ix1) \quad (1)$$

$$y=k(Iy2-Iy1)/(Iy2+Iy1) \quad (2)$$

The beam spot position where both (Ix2−Ix1), (Iy2−Iy1) are zero is defined as the electrical and mechanical coordinate origin (0, 0) of PSD sensor 11. Target plate 40 needs to be positioned two-dimensionally with respect to PSD sensor 11 within an allowable accuracy range.

Inasmuch as the impact position (x, y) calculated according to the above equations is affected by the amount Σ of light due to the characteristics of PSD sensor 11, impact position calculator 16 thereafter divides the value of the impact position (x, y) by the signal representing the amount Σ of light, thus correcting the shot impact position of laser beam 30 on target plate 40.

With target device 10 shown in FIGS. 5 and 7, as described above, the signal represented by the current output from photodiode sensor 12 is subtracted from the signal represented by the currents output from PSD sensor 11, thus removing the signal component based on the extraneous light other than laser beam 30 detected by PSD sensor 12. Using the signal from which the signal component based on the extraneous light has been removed, the shot impact position of laser beam 30 on target plate 40 and the shot impact position detecting signal contained in laser beam 30 shot from laser gun 20 are detected. Accordingly, the shot impact position of laser beam 30 on target plate 40 is detected without noise and error.

In the present embodiment, the shot impact position on target plate 40 which is detected by target device 10 and the score depending on the shot impact position are displayed on display unit 91. However, the shot impact position and the score depending on the shot impact position may be displayed on target device 10. According to such a modification, the score is calculated by target device 10 based on the shot impact position on target plate 40.

In the present embodiment, the shot impact position of laser beam 30 on target plate 40 mounted on target device 10 is calculated using the currents (Ix1, Ix2) along the x-axis and the currents (Iy1, Iy2) along the y-axis which are generated by PSD sensor 11. However, the currents generated by PSD sensor 11 and photodiode sensor 12 may be converted into voltage values at stages preceding amplifiers 13*a*, 13*b*, and impact position calculator 16 may calculate the shot impact position of laser beam 30 on target plate 40 mounted on target device 10, using these voltage values instead of the current values described above.

In the present embodiment, target device 10 for detecting the shot impact position of laser beam 30 shot from laser gun 20 on target plate 40 has been described. However, a light detecting device for receiving a light beam having a predetermined pulse signal and detecting a beam spot position where the light beam hits the light detecting device may be similarly arranged to detect the beam spot position without the need for an optical filter.

While a preferred embodiment of the present invention has been described in specific terms, such description is for illustrative purposes only, and it is to be understood that changes and variations may be made without departing from the spirit or scope of the following claims.

What is claimed is:

1. A target device for detecting a shot impact position of a light beam shot from a light gun on a target plate, comprising:

beam detected position detecting means for detecting the light beam which has hit the target plate and generating a current based on the shot impact position;

extraneous light detecting means for generating a current based on only extraneous light applied to the target device; and circuit means for subtracting the current generated by said extraneous light detecting means or a voltage based on said current from the current generated by said beam detected position detecting means or a voltage based on said current, thereby producing an extracted light component, and recognizing the light beam shot from said light gun and detecting the shot impact position of the light beam on said target plate based on said extracted light component.

2. A target device according to claim 1, wherein said circuit means comprises:

subtracting means for subtracting the current generated by said extraneous light detecting means or a voltage based on said current from the current generated by said beam detected position detecting means or a voltage based on said current, and outputting a differential current or voltage value; and position calculating means for recognizing the light beam shot from said light gun and detecting the shot impact position of the light beam on said target plate based on said differential current or voltage value.

3. A target device according to claim 2, wherein said position calculating means comprises means for recognizing the light beam shot from said light gun by detecting a shot impact position detecting signal contained in the light beam shot from said light gun.

4. A target device according to claim 2, wherein said beam detected position detecting means comprises means for generating a first current based on a positional component of said shot impact position along an x axis of an xy coordinate system and a positional component of said shot impact position along a y-axis of the xy coordinate system, and said position calculating means comprises means for calculating an x coordinate in the xy coordinate system of said shot impact position from a value which is produced by subtracting the current generated by said extraneous light detecting means or the voltage based on said current from said first current or a voltage based on said first current, and a value which is produced by subtracting the current generated by said extraneous light detecting means or the voltage based on said current from the sum of said first current and said second current or the sum of said voltage based on said first current and a voltage based on said second current, and calculating a y coordinate in the xy coordinate system of said shot impact position from a value which is produced by subtracting the current generated by said extraneous light detecting means or the voltage based on said current from said second current or the voltage based on said second current, and a value which is produced by subtracting the current generated by said extraneous light detecting means or the voltage based on said current from the sum of said first current and said second current or the sum of said voltage based on said first current and the voltage based on said second current.

5. A target device according to claim 3, wherein said beam detected position detecting means comprises means for generating a first current based on a positional component of said shot impact position along an x axis of an xy coordinate system and a positional component of said shot impact position along a y-axis of the xy coordinate system, and said position calculating means comprises means for calculating an x coordinate in the xy coordinate system of said shot impact position from a value which is produced by subtracting the current generated by said extraneous light detecting means or the voltage based on said current from said first current or a voltage based on said first current, and a value which is produced by subtracting the current generated by said extraneous light detecting means or the voltage based on said current from the sum of said first current and said second current or the sum of said voltage based on said first current and a voltage based on said second current, and calculating a y coordinate in the xy coordinate system of said shot impact position from a value which is produced by subtracting the current generated by said extraneous light detecting means or the voltage based on said current from said second current or the voltage based on said second current, and a value which is produced by subtracting the current generated by said extraneous light detecting means or the voltage based on said current from the sum of said first current and said second current or the sum of said voltage based on said first current and the voltage based on said second current.

6. A light detecting device for receiving a light beam having a predetermined pulse signal and detecting a beam spot position where the light beam hits the light detecting device, comprising:

beam detected position detecting means for detecting the light beam and generating a current based on the beam spot position;

extraneous light detecting means for generating a current based on extraneous light applied to the light detecting device; and circuit means for subtracting the current generated by said extraneous light detecting means or a voltage based on said current from the current generated by said beam detected position detecting means or a voltage based on said current, thereby producing an extracted light component, and detecting said pulse signal and the beam spot position of the light beam having the pulse signal based on said extracted light component.

7. A light detecting device according to claim 6, wherein said circuit means comprises:

subtracting means for subtracting the current generated by said extraneous light detecting means or a voltage based on said current from the current generated by said beam detected position detecting means or a voltage based on said current, and outputting a differential current or voltage value; and position calculating means for detecting said pulse signal and calculating the beam spot position of the light beam having the pulse signal based on said differential current or voltage value.

8. A target device for detecting a shot impact position of a light beam shot from a light gun on a target plate, comprising:

a position detector that detects the light beam which has hit the target plate and generates a first signal based on the shot impact position;

a photosensor that generates a second signal based on only extraneous light applied to the target device; and a subtractor circuit that subtracts the second signal generated by said photosensor from the first signal generated by said position detector, thereby producing an extracted light component, and detects the shot impact position of the light beam on said target plate based on said extracted light component.

9. A target device according to claim 8, wherein the subtractor circuit outputs a differential signal, and an impact position calculator recognizes the light beam shot from said light gun based on said differential signal.

10. A target device according to claim 8, wherein the light beam has a predetermined pulse signal.

* * * * *